US008776698B2

(12) United States Patent
Pherson

(10) Patent No.: US 8,776,698 B2
(45) Date of Patent: Jul. 15, 2014

(54) COMPOSITE AIR CARGO PALLET

(71) Applicant: Advanced Composite Structures, LLC, Charleston, SC (US)

(72) Inventor: Thomas R. Pherson, Daniel Island, SC (US)

(73) Assignee: Advanced Composite Structures, LLC, Charleston, SC (US)

( * ) Notice: Subject to any disclaimer, the term of this patent is extended or adjusted under 35 U.S.C. 154(b) by 0 days.

(21) Appl. No.: 13/795,604

(22) Filed: Mar. 12, 2013

(65) Prior Publication Data

US 2014/0096708 A1 Apr. 10, 2014

Related U.S. Application Data

(60) Provisional application No. 61/710,802, filed on Oct. 8, 2012.

(51) Int. Cl.
*B65D 19/00* (2006.01)

(52) U.S. Cl.
USPC ..... 108/51.3; 108/57.25

(58) Field of Classification Search
CPC ..... B65D 2519/00019; B65D 2519/00034; B65D 2519/00039; B65D 2519/00044; B65D 2519/00049; B65D 2519/00069; B65D 2519/00074; B65D 2519/00079; B65D 2519/119; B65D 2519/124; B65D 2519/139; B65D 2519/144; B65D 2519/149; B65D 2519/358; B65D 2519/00119; B65D 2519/00124; B65D 2519/00139; B65D 2519/00144; B65D 2519/00149; B65D 2519/00358
USPC ..... 108/51.11, 51.3, 57.25, 55.1
See application file for complete search history.

(56) References Cited

U.S. PATENT DOCUMENTS

| | | | | |
|---|---|---|---|---|
| 3,396,678 | A * | 8/1968 | Jensen | 248/346.02 |
| 3,428,002 | A * | 2/1969 | McIntire, Jr. et al. | 248/346.02 |
| 3,429,536 | A | 2/1969 | Petry et al. | |
| 3,509,832 | A * | 5/1970 | Daisley, Jr. | 108/57.25 |
| 3,511,737 | A | 5/1970 | Oita et al. | |
| 3,591,121 | A * | 7/1971 | Parris | 248/346.02 |

(Continued)

FOREIGN PATENT DOCUMENTS

| | | |
|---|---|---|
| EP | 1503896 B1 | 9/2011 |
| WO | 9725250 | 7/1997 |
| WO | 2011093699 A1 | 8/2011 |
| WO | 2012023849 | 2/2012 |

OTHER PUBLICATIONS

International Search Report and Written Opinion for PCT/US2013/062961, dated Mar. 18, 2014, 11 pgs.

*Primary Examiner* — Jose V Chen
(74) *Attorney, Agent, or Firm* — Womble Carlyle Sandridge & Rice, LLP

(57) ABSTRACT

An air cargo pallet with a central panel created from a plurality of sandwiched layers, including a foam core disposed between an upper skin layer having a resin and fiber combination and a lower skin layer having a resin and fiber combination. The central panel is reinforced with additional fibers extending through the lower skin layer, the foam core and the upper skin layer. An interface layer is disposed around the periphery of the foam core and bonded between the upper skin layer and the lower skin layer to complete the central panel. The pallet is then formed by snap fitting a plurality of rails around the circumference of the central panel by connection to the interface layer.

19 Claims, 5 Drawing Sheets

(56) References Cited

U.S. PATENT DOCUMENTS

| | | | | | |
|---|---|---|---|---|---|
| 3,622,114 | A | | 11/1971 | McIntire, Jr. | |
| 3,626,860 | A | * | 12/1971 | Blatt | 108/51.3 |
| 3,719,157 | A | * | 3/1973 | Arcocha et al. | 108/57.25 |
| 4,230,049 | A | * | 10/1980 | Horne | 108/57.28 |
| 4,347,794 | A | | 9/1982 | Nordstrom | |
| 4,404,889 | A | * | 9/1983 | Miguel | 428/118 |
| 4,558,553 | A | * | 12/1985 | Kolk | 108/27 |
| 4,874,648 | A | | 10/1989 | Hill et al. | |
| 5,195,439 | A | * | 3/1993 | Harder | 108/57.12 |
| 5,205,221 | A | * | 4/1993 | Melin et al. | 108/51.3 |
| 5,284,098 | A | * | 2/1994 | Klapperich et al. | 108/55.5 |
| 5,360,129 | A | | 11/1994 | Lee | |
| 5,567,500 | A | * | 10/1996 | Marshall et al. | 428/116 |
| 5,687,652 | A | * | 11/1997 | Ruma | 108/57.25 |
| 5,981,025 | A | * | 11/1999 | Marshall et al. | 428/116 |
| 6,117,518 | A | * | 9/2000 | Cawse et al. | 428/116 |
| 6,214,436 | B1 | * | 4/2001 | Catta et al. | 108/27 |
| 6,308,642 | B1 | * | 10/2001 | Branam et al. | 108/55.1 |
| 6,655,299 | B2 | * | 12/2003 | Preisler et al. | 108/51.3 |
| 6,705,237 | B2 | * | 3/2004 | Moore et al. | 108/57.25 |
| 6,758,148 | B2 | * | 7/2004 | Torrey et al. | 108/51.11 |
| 7,013,814 | B2 | * | 3/2006 | Modesitt et al. | 108/51.3 |
| 7,785,693 | B2 | | 8/2010 | Johnson et al. | |
| 7,846,528 | B2 | | 12/2010 | Johnson et al. | |
| 7,854,204 | B2 | | 12/2010 | Dacus | |
| D630,815 | S | * | 1/2011 | Teien | D34/38 |
| 8,002,919 | B2 | | 8/2011 | Johnson et al. | |
| 8,567,324 | B1 | * | 10/2013 | Paradis et al. | 108/51.3 |
| 2007/0194019 | A1 | | 8/2007 | Seagle et al. | |
| 2008/0145592 | A1 | | 6/2008 | Johnson | |
| 2008/0237305 | A1 | | 10/2008 | Rennick et al. | |
| 2009/0116925 | A1 | | 5/2009 | Juchniewicz et al. | |
| 2009/0277579 | A1 | | 11/2009 | Marelli et al. | |
| 2011/0120353 | A1 | * | 5/2011 | Jensen et al. | 108/57.25 |
| 2011/0247958 | A1 | | 10/2011 | Lucas et al. | |

* cited by examiner

COMPOSITE AIR CARGO PALLET

PRIORITY

This application claims the benefit of U.S. Provisional Application No. 61/710,802, filed Oct. 8, 2012.

FIELD OF THE INVENTION

This application relates to cargo pallets, particularly cargo pallets and container bases made from composite panels having metal rails, resulting in improved durability and stiffness for use in weight sensitive applications such as shipment of cargo via airplane.

BACKGROUND OF THE INVENTION

Air cargo is typically transported in containers ("Unit Load Devices"), or on pallets combined with nets, that are stowed in cargo holds either below the deck of passenger aircraft or below and above the deck in transport aircraft. The size and shape of cargo pallets vary depending upon the type of aircraft in use. In all aircraft, the gross weight of the airplane is a substantial factor, because of the cost of fuel.

Current air cargo pallets and containers are often made of aluminum skin on a hollow frame structure. A limited number have added bulsa wood or plywood cores, with very limited success. Such pallets are roughly handled and easily damaged when loaded into or unloaded from aircraft, and many problems therefore occur with such aluminum pallets. Aluminum pallets have various disadvantages, including their weight and their limited stiffness/weight ratio, thereby requiring additional weight distributing planks when carrying an unevenly distributed load.

SUMMARY OF INVENTION

This disclosure describes composite pallets intended for use in the transportation of air cargo. In this industry, weight is at a premium and the handling can be rough. When shipping cargo by air, every additional kilogram can substantially increase the cost of jet fuel necessary to operate the aircraft over the course of a year. Pallets of the present disclosure, while equaling or surpassing the strength and stiffness of prior art pallets, have been found to weigh at least 5% less and up to 20% less than even primarily aluminum bodied pallets.

Aircraft also have weight limits, and every kilogram that can be removed from the pallet can leave room for an additional kilogram of paid freight. The inventor estimates that for each kilogram of weight reduction, the shipper can save upwards of $60 per year. This amounts to about $860 per pallet per year. Extrapolated over the weight savings per pallet, times the number of pallets used throughout a fleet, this reduction in weight can lead to significant fuel savings and the added benefit of reducing carbon dioxide emissions from the burning of that fuel.

The air cargo industry is also known to be extremely rough on cargo and pallets. The pallets are often damaged by forklifts, or run into other pallets, unit load devices, or the walls of the cargo hold since the pallets are required to fit precisely within the aircraft. Even though intended for air cargo use, the pallets of this disclosure may also be useful in alternative shipping, transportation or warehousing uses.

The inventor has created an air cargo pallet having a central composite panel comprising a sandwich structure having a non-metal upper fabric skin layer, a foam core and a non-metal lower fabric skin layer. A plurality of high modular solid reinforcing fibers extend completely through the panel to maintain lamination of the skin layers with the core and to strengthen and stiffen the panel. A plurality of rails is disposed around the circumference of the composite panel to protect the edges thereof. It should be understood that "pallet," as used herein is also intended to include the base or floor of air cargo containers, sometimes referred to as "ULD's."

These and other aspects of the present invention will become apparent to those skilled in the art after a reading of the following description of the preferred embodiments, when considered in conjunction with the drawings. It should be understood that both the foregoing general description and the following detailed description are exemplary and explanatory only and are not restrictive of the invention as claimed.

DETAILED DESCRIPTION OF THE DRAWINGS

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
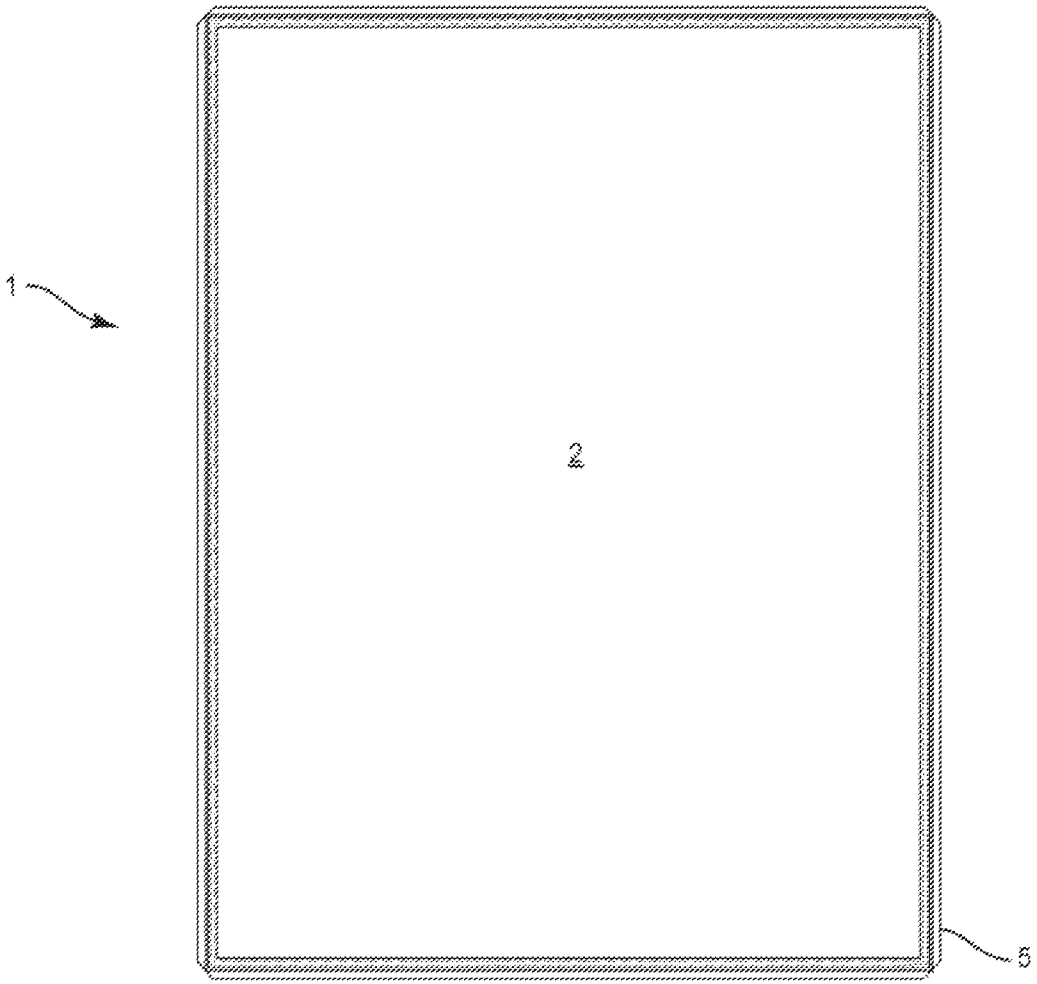
FIG. 1 is a top view of a pallet according to the present disclosure.

Turning to FIG. 1, an air cargo pallet 1 is shown. The air cargo pallet 1 includes a central composite panel 2 and a plurality of rails 5 disposed around the panel 2 to protect the edges thereof. The composite panel 2 of the pallet 1 comprises a sandwich structure having a core 21 and at least a top skin 25 and a bottom skin 29. Again the pallet 1 may be utilized as simply a pallet, or it may form the base or floor of an air cargo container.

The core 21 may comprise a foam material such as polyurethane foam. Alternate foam materials for use in forming the core 21 include vinyl and acrylic. Phenolic foam may so be selected to provide high temperature/fire resistance because phenolic foam does not easily burn, melt or degrade even when charred. Additional materials that could be used to form fire resistant foam have been discussed in co-pending application Ser. No. 13/337,906, filed Dec. 27, 2011, which is hereby incorporated by reference.

Using polyurethane foam having a density of about 2 lbs/$ft^3$ has been found to provide a beneficial cost/weight/strength ratio, though foam having a density between about 0.75 lbs/

$ft^3$ and about 20 lbs/$ft^3$ could be used. The higher density foam is generally more expensive, would likely improve the pallet's ability to resist compressive forces, but would also add to the weight of the pallet 1.

The foam core 21 should have a compressive strength of between 5 and 3000 psi. Using the 2 lbs/$ft^3$ polyurethane foam discussed above results in a compressive strength of 15 psi.

The core 21 should comprise a closed-cell foam. Since liquid resin may be used to form or reinforce the skins 25, 29, it is important that the core 21 be unable to "soak up" extra resin where unintended. The closed-cell foam provides enough surface "roughness" for excellent bonding without allowing resin to fully impregnate the core 21.

The core 21 may also include a honeycomb structure (not shown) filled with foam. The use of a honeycomb may increase strength of the panel 2, in both compression and shear, but would again increase the cost and weight of the resulting pallet.

The skins 25, 29 are formed of a fiber and resin combination. Skins 25, 29 can be a woven fabric composite, angle-plied unidirectional fiber composite, or a combination of both, all with a resinous binder. The woven fabric composites generally are tougher and more resistant to damage. The angle-plied unidirectional composites are generally stiffer and allow better "customization" of properties. Combining both types of composite in separate layers may provide a hybrid result.

The skins 25, 29 may comprise fibers from one or more of the following materials: fiberglass, carbon, aramid, basalt, Ultra-high Molecular Weight Polyethylene Fibers (UHMWPE), PBO, Liquid-crystal Polymers or the like. Use of aramids, UHMWPE or fabrics formed of such fibers would provide the bottom of the pallet 1 with protection from abrasion due to sliding on rough surfaces, and may protect the top of the pallet 1 from abrasion due to sliding crates, pallets or other items placed on the top surface. These materials also add to the impact strength and may be used to improve the toughness of the pallet 1. If increased compressive strength properties are needed to handle all of the loads required of the pallet 1, a hybrid structure using a combination of different material fibers may be used. The proposed fiber materials could also provide the benefit of fire resistance, since some of the listed materials have very high melting temperatures, will not burn and will not degrade structurally, up to 1500 degrees F.

As with all composite materials, the fibers listed above can be used in various constructions. The choice of construction is based on required structural properties, toughness and cost. The type of fibers can be mixed or blended in all construction types to provide hybrid properties.

By way of example, fibers can be laid up in a unidirectional pattern in which the fibers in a given layer are straight and lined up. Bulk properties are then generated by the number of layers and the fiber angle of each layer compared to the other layers. Stiffness and strength is optimized, but toughness is often sacrificed.

Fiber may also be woven into one of many constructions common to the weaving industry. Fiber angle can also be varied either by the weaving process or by the lay up process. Toughness is optimized at the expense of stiffness and strength in this approach. There is also the possibility of what can be referred to as "3D-woven," which is similar to woven except that fibers are placed in the Z axis to provide resistance to delamination between layers or plies. This is generally an expensive approach.

In another non-woven approach, fiber is placed in a more random orientation. In this approach, typically shorter fibers are used, and a number of constructions are possible such as continuous strand mat, chopped strand mat, needle punch, and felt.

The thickness of the skin or laminate can be discretely changed by varying the number of layers, or by the thickness of each individual layer, or by a combination of both. All layers can be of the same fiber material or can be of different fiber blends. The resin used (discussed below) is generally the same in all layers, but not necessarily so as they could be different.

The fibers are then infused, coated, or impregnated with one or more thermoplastic or thermosetting resin. The resin binds the fibers together, giving them structural strength. Potential resins include Epoxy, polyester, vinyl ester, polyurethane, polyimides, phenolics, polyamides, polyesters, polycarbonates and the like.

Reinforcement fibers 30 extend through each skin 25, 29 and the core 21. Reinforcement fibers are typically high modulus fibers similar to those fibers used to form skins 25, 29, such as fiberglass, carbon, aramid, basalt, Ultra-high Molecular Weight Polyethylene Fibers, PBO, Liquid-crystal Polymers or the like, having a fiber modulus of over 5,000,000 psi. These reinforcement fibers 30 provide support for the compressive forces applied by the pallet's load. Reinforcement fibers 30 create a three dimensional structure which adds compressive strength, prevents delamination of the skins 25, 29 from the core 21, allows very high shear deformations without failure, and controls spread of damage. U.S. Pat. Nos. 7,785,693, 7,846,528, and 8,002,919 assigned to Ebert Composites Corporation provide examples of reinforcement fibers extending through both core and skin layers of a composite structure, these patents are incorporated herein.

The reinforcement fibers 30 extend through both skins 25, 29 and the core 21. The reinforcement fibers 30 serve like nails to hold the skins 25, 29 together to prevent delamination. It should be noted here that the resinous binder applied to the fibers of the skin also travel along the reinforcement fibers 30, which causes them, when cured, to become rigid. In order to delaminate the panel 1, you would have to break each one of the reinforcement fibers 30, which takes 200-300 lbs each. The reinforcement fibers 30 may be inserted to extend above and below the top 25 and bottom 29 skins respectively. The extra length of reinforcing fiber 30 can then be folded against the respective skin once impregnated with resin, further holding the skins in place.

The angle A of the reinforcement fibers 30 may be perpendicular (90°) to the skin surface or any angle down to 30° relative to the skin surface. Using a combination of fibers 30 angled at both about 90° and about 45° has been contemplated to provide both compressive and shear strength. Higher shear properties may be desirable near the edges and corners to help transfer load towards the center of the pallet.

Figure 2:
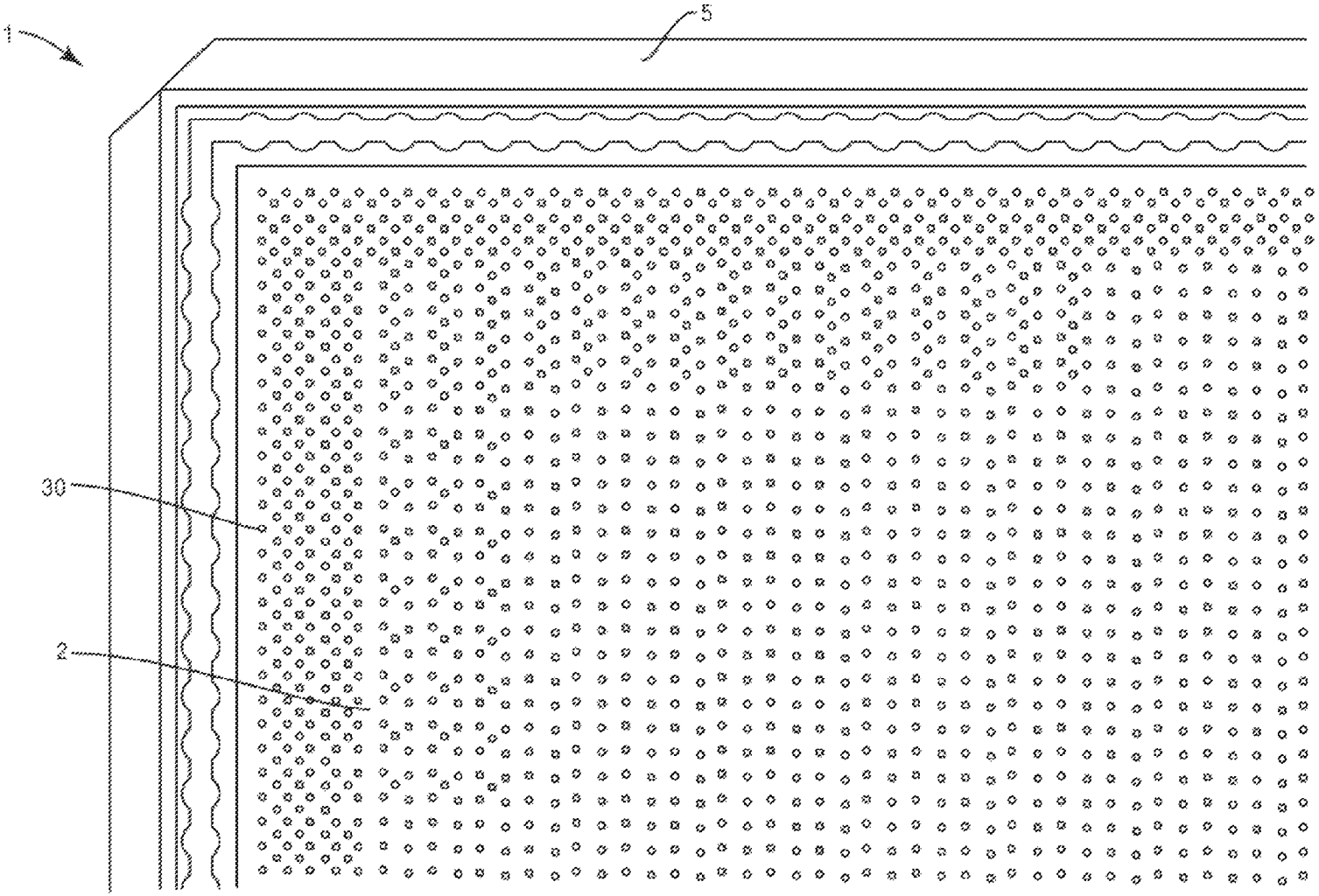
FIG. 2 is a partial schematic top view of a pallet of the present disclosure illustrating the placement of reinforcing fibers.

FIG. 2 shows the arrangement of reinforcement fibers 30 within the panel 2. The areal density of the reinforcement fibers 30 is preferably varied such that more reinforcement fibers 30 are located in areas of higher stress to help carry load. In areas of low stresses, fiber density can be reduced to save weight. Densities can range from less than 0.25/sq. inch to an upper limit of approximately 16 per square inch. Although varied density it preferred, the reinforcement fibers 30 could be uniformly disposed throughout the panel 2.

A pallet 1 having the panel 2 formed of the materials described above can be more than thirty times stiffer than conventional pallets having an aluminum sheet surrounded by an aluminum frame. This stiffness reduces deflection of the pallet 1 between rollers of a cargo loading or transport conveyor system. Reduced deflection makes rolling easier and puts less stress on both the pallet 1 and the loading system.

Providing a pallet 1 with increased stiffness allows the elimination of "shoring" or reinforcement for many loading applications. Shoring is used to spread out localized surface loads over a larger area. Aircraft flooring systems are rated at less than 200 lbs/ft2 for lower deck cargo and 400 lbs/ft2 for upper deck cargo. If the areal load exceeds these values, then lumber, wooden pallets or other load-spreading devices must be used to spread load over a larger area. This shoring adds labor, material cost, and most importantly weight to a pallet or container base. This extra weight translates directly to higher fuel costs and lower paid cargo capacity.

The panel 2 of pallet 1 is provided with a plurality of rails 5. Preferably, rails 5 are removable in the case of damage. Air cargo pallets 1 and containers are subject to considerable abuse during handling. Since it is difficult to produce a damage-proof exterior rail structure, it is extremely important that a damaged rail 5 can be economically removed using tools common in the industry and replaced. It is possible for damage to occur anywhere in the world, so the requirement of highly specialized equipment to replace such rails 5 would create a significant disadvantage. The easy replacement of rails 5 allows economical repair without replacement of entire pallet 1.

Alternatively, the rails 5 could be permanently affixed to the pallet 1 to save weight and cost. For certain applications, it may be preferable to have rails 5 that are not removable. This would allow a lower weight and cost, but would require replacement of an entire pallet in the event of damage to even one rail 5. Aviation regulations are very strict and generally require that any major damage be repaired before a damaged pallet can be returned to service so cost and speed or repair or replacement is important to avoid downtime.

Rails 5 are used around the periphery of the panel 2 to interface with aircraft cargo handling systems. The rails 5 may be metal such as aluminum or may be pultruded or molded composite materials. The rails 5 are provided with a profile and dimensions to provide the pallet 1 with the ability to integrate with existing pallets and loading systems as described in the IATA Technical Manual. The rails 5 are the interface to the floor in the aircraft. The rails 5 have to be a certain geometry and the pallets 1 have an exact outside dimension +/−0.030" so that they fit in the plane. The rails 5 have an angle 57 on the outside so that a fork truck can slide the forks underneath the unit (even when loaded). The rails 5 also act as bumpers as the pallets 1 run into walls and each other. The rails 5 must take tremendous abuse from forklifts. For example, a forklift driver may attempt to go underneath the rail 5, but instead hit the rail 5 directly. The rails 5 can also have a "seat track" 59 on the top surface. This track 59 is used to attach straps and pallet nets (not shown) to in order to secure the cargo onto the pallet 1. The attachment points on the track 59 are on 1" centers to allow placement of the straps or nets anywhere. When used as the base of an air cargo container or ULD, the track 59 may be used to attach the walls or door (curtain) of a container.

In a preferred embodiment, the rails 5 are created from aluminum extrusions that meet all current aircraft interface standards. The exterior surface of each rail 5 is thicker to allow for protection from the impacts that inevitably occur in day-to-day handling of pallets. Interior arms 51, 52 have grooves 55 to accept the ribs 43 that are on the adjacent interface member (discussed further below) 40. The inner arms 51, 52 are thinner, and curved, to minimize the stresses that can occur during cyclic bending. In this embodiment, there is no vertical connection between the two arms 51, 52. This allows the arms to bend inward when the interface member 40 is compressed, minimizing localized stresses at the joint between the composite panel 2 and the edge rail 5.

Figure 3:
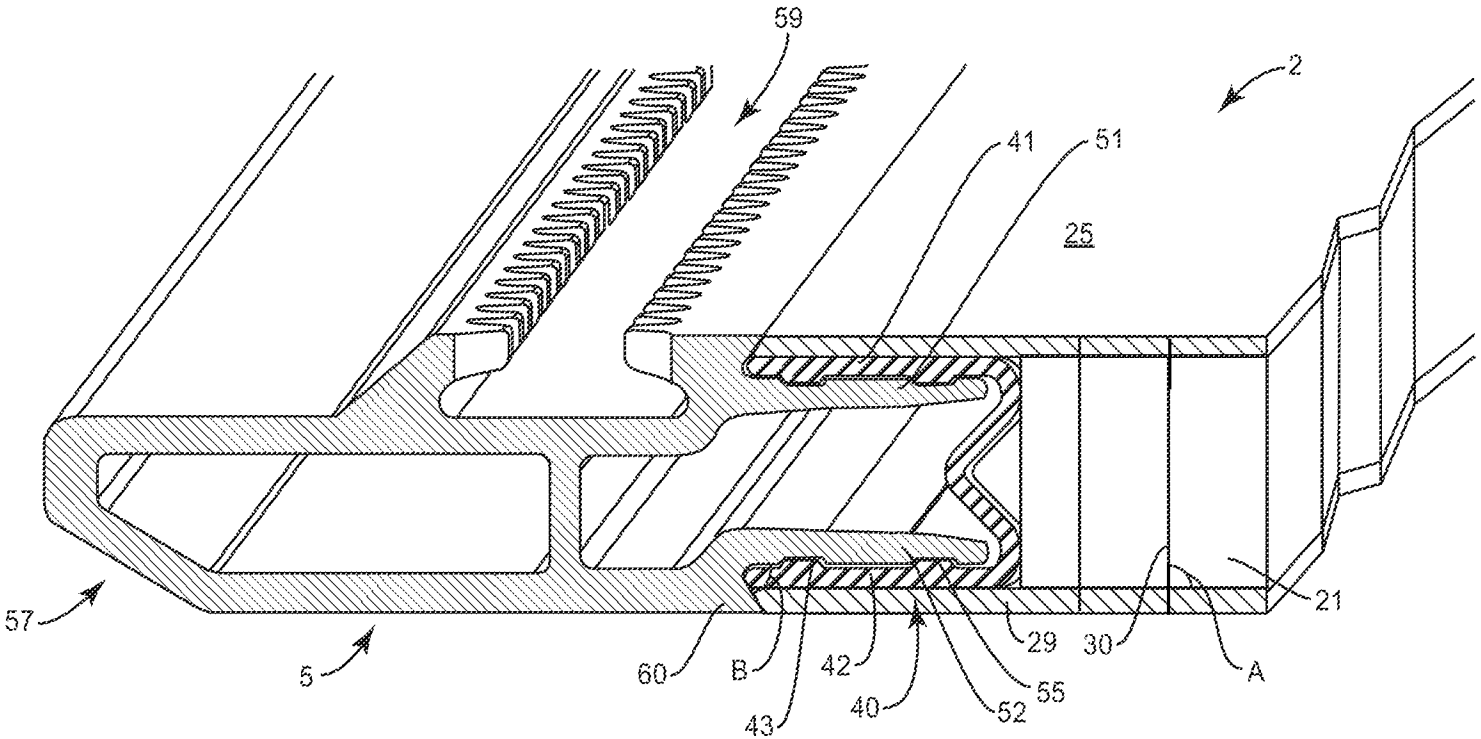
FIG. 3 is a partial cross section of a first embodiment of the present disclosure.

As seen in FIG. 3, panel 2 may include an interface member 40. Skins 25, 29 each include an outwardly extending flange that protrudes past the edge of core 21 to provide for the attachment of rails 5. The interface member 40 is disposed around the periphery of the core 21 between the flange of top skin 25 and the flange of bottom skin 29. The interface member 40 shown in FIG. 3 has a cross section similar to an upper case sigma. This shape allows vertical compression under cyclic loading, which can reduce the stress concentration that may occur at the edge of the interface member 40, especially when the panel skin is thin. Alternative cross sectional shapes for interface member 40 include a sideways U-shape with square or rounded bottom. The square version will increase stress at the shape corners, while the rounded bottom shape requires removal of additional core material and corresponding reinforcement fibers, compared to the preferred sigma shape. Two separate unconnected members (not shown) may also combine to form the interface member 40 to reduce weight but provide significantly less resistance to compressive loads.

In a preferred embodiment, the interface member 40 is bonded to the inside of the flange portion of skins 25, 29 to facilitate the attachment of the metal or composite protective edge rails 5. Adhesive bonds are strongest and most durable when similar materials are bonded together, because the bonded materials have similar chemical nature, modulus, and Coefficient of Thermal Expansion (CTE). A bond between similar materials typically has lower interfacial stresses and can be expected to be more durable than bonds between dissimilar materials. Therefore, the interface member 40 preferably includes a binder resin similar to the resin used to form skins 25, 29 and similar fibers as well. The cross section of the interface member 40 provides a relatively large bonding area with the flange portion of skins 25, 29 to distribute the fastening stresses over a large area. Adhesives having shear strengths of over 3000 psi are preferred for bonding the skins 25, 29 to the interface member 40. This step is performed after the skin/core panel has been fabricated.

Figure 4:
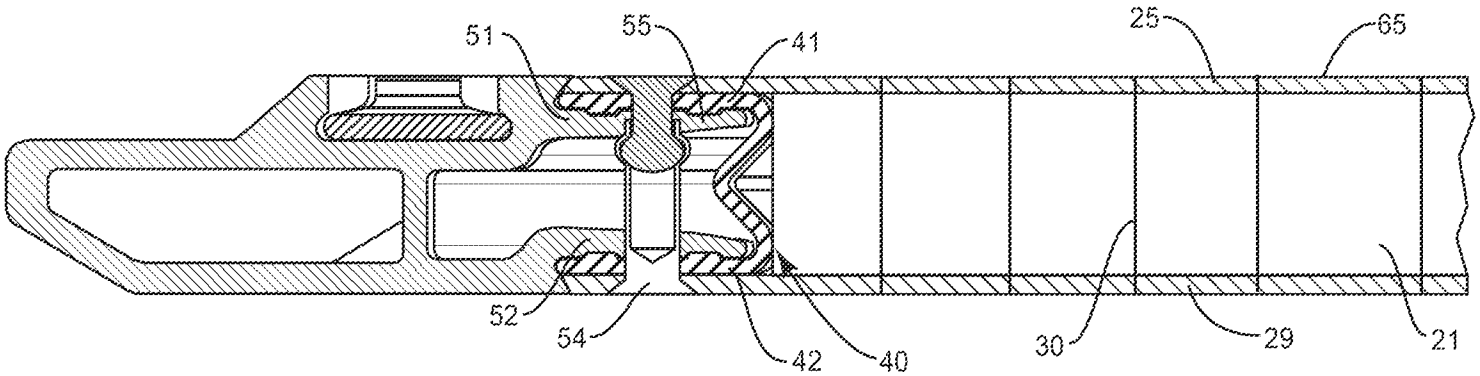
FIG. 4 is a partial cross section of the first embodiment of the present disclosure with additional fastening structure.

As seen in FIG. 3, the interface member 40 has projections 43 extending in an inward direction relative to the thickness of the panel 2. At least one projection 43 should extend from the upper 41 and lower 42 portions of the interface member 40. In a preferred embodiment, the projections 43 are in the form of ribs extending the length of the interface member 40. The projections 43 could also take the form of discrete segments. The projections 43 act to spread the high shear loading between the rail 5 and the panel 2 that occurs in the case of cyclic loading, such as would be seen by the pallet 1 because of repeated loading and unloading of cargo. The snap fit embodiment illustrated in FIG. 3 does not use mechanical fasteners, however fasteners, such as rivets can be added as illustrated in FIG. 4.

The use of fasteners 54, can be used to hold the rails 5 in place without the presence of projections 43 and grooves 55. However, without the projections 43, mechanical fasteners, such as rivet 54 (FIG. 4), tend to cause high stress areas leading to failure of other composite panels in short amounts of times. Thus, by including the rib projections 43, the stresses surrounding the individual fasteners 54, if included, are much lower. The fasteners 54 serve mainly in a tensile mode to securely hold the interface layer 40 to both the outer skins 25, 29 of the panel 2 and to the removable rails 5. By compressing the three layers 25, 29, 40 together using fasteners 54, shear stress is better transferred from the rail 5 without having any highly localized loads. In addition, the compression fasteners 54 help prevent peel and delamination of the skins 25, 29 from the core 21.

The projections 43 extending from the upper 41 and lower 42 portions of the interface member 40 mate with grooves 55 formed in an upper arm 51 and a lower arm 52 extending from each rail 5. The snap fit of the projections 43 with the grooves 55 hold the rails 5 in place relative to the panel 2 and, in case of damage, allow the rails 5 to be removed from the panel 2 without undue burden. Note that projections 43 and grooves 55 can be reversed with protections from the rail arms 51, 52 and grooves in the interface member 40.

The interface member 40 allows the frame rails 5 to snap into place. The projections 43 in the interface member 40 serve to carry the shear loading from impact or bending. If the projections 43 were not there, the rivets 54 would have to do this and would start stressing the composite panel 2 or elongating the rivet holes. The interface member 40 also adds thickness to the edge of panel 2 to help add extra support in this high stress area. In a preferred embodiment, the interface member 40 is a piece of solid fiberglass composite that is precisely glued into the panel 2 so that when the aluminum rail 5 is snapped into place, all the critical outside dimensional requirements of the pallet 1 are met.

In order to supplement the snap fit connection between the panel 2 and the rails 5, flat head rivets 54 may be used that are flush or below the surface of the skins 25, 29 to minimize wear. The rivets 54 are also below the surface to prevent damage to aircraft loading systems on the bottom or cargo on the top of the pallet 1. FIG. 4 shows a mate rivet that can be installed all of the way through both skins 25, 29. This type of rivet allows the use of one through-hole to fasten both sides, therefore only half of the rivets are necessary compared to the use of individual rivets. A possible disadvantage is that a mate rivet only clamps one of the surfaces together and serves to compress the entire panel/rail configuration. Alternatively, a standard blind rivet may be installed from one side into the opening between arms 51, 52 of rail 5. Because the blind rivet penetrates only one if the skins 25, 29, (along with the interface member 40 and single rail arm), an additional rivet must be installed from the other surface. In the case that the space height is not sufficient to support two rivets, the rivets must be offset to prevent interference.

In order to remove the rails 5, the rivets 54 can be drilled out. The damaged rail 5 will be able to simply snap out. A new rail 5 can be easily snapped back into place. The projections 43 on the interface member 40 allow the aluminum (or composite) edge rail 5 to be relocated into exactly the same position as the rail 5 that came out. This maintains the tight tolerances on the outside size of the pallet 1.

Figure 5:
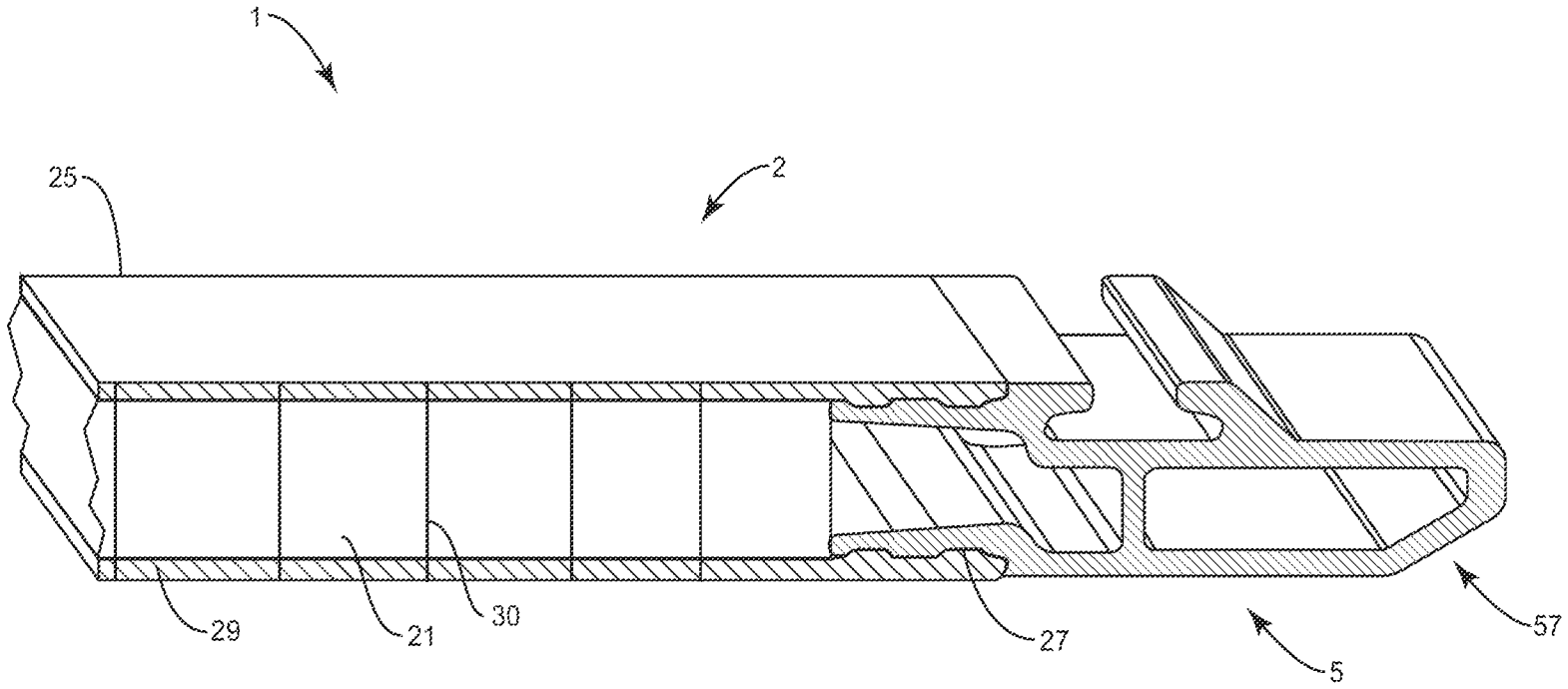
FIG. 5 is a partial cross section of a second embodiment of the present disclosure.

In a second embodiment, as seen in FIG. 5, the interface member 40 may be omitted. In order to provide sufficient strength and resistance to cyclical sheer and compressive loads, the skins 25 and 29 will have be of sufficient thickness to provide room for the formation of projections/grooves 27 without overly weakening the skins 25 and 29.

Referring back to FIG. 3, the interface between composite panel 2 edge and edge of rail 5 can be seen. The rail edge provides an angled overhang 60 that traps a respective skin 25 and a portion of the interface member 40. The angled overhang 60 is preferably angled B from about 30° to about 90°. The overhang 60 protects the edges of the skin 25 and interface member 40 and converts compressive forces created by severe edge rail impacts into compressive force acting through the lamina on the composite skins. A 90° interface would have no vertical force component to compress the lamina. Instead, it would tend to buckle and delaminate the edge. Therefore the angle of the overhang 60 is more preferably between about 45° and about 60°.

Composite panels 2 may require additional layers to provide the skins 25, 29 with improved abrasion resistance. Repeated motion over the ball or cylindrical rollers typical of cargo loading or transporting conveyors can cause significant wear to the bottom composite skin. Not only does this damage the skin, perhaps leading to premature failure, but also the wear debris from the composite skin can damage aircraft flooring systems or cargo loading systems. Testing has shown that polyurethane or similar coatings 65 can greatly reduce panel damage caused by conveyor wear. These coatings 65 can be sprayed-on, rolled-on, powder-coated or comprise a laminated film.

A panel 1 with enhanced wear resistance can be formed by the following method. First, a layer of reinforcing woven or non-woven cloth (i.e. "scrim") is laminated to a thermoplastic or thermoset wear resistant extruded film 65 such as polyurethane. The polyurethane film may be between 0.005"-0.040" thick. During lamination, the cloth should avoid being completely impregnated with the polymer from the film, thereby leaving a dry side of the cloth that remains capable of absorbing further resin later in the process.

The process continues as follows: foam for core 21 is supplied at a predetermined thickness; dry fabric to form skin layers 25, 29, woven or unwoven, is supplied on rolls either individually, or pre-plied to the proper layup configuration; the foam is fed into a pultrusion machine sheet by sheet; the fabric is unrolled onto the foam on both sides thereof; then the reinforcement fibers 30 can be inserted through the top fabric layer, the foam, and then through the bottom fabric layer.

The laminated scrum described above is then applied to the top and bottom fabric layers, with the dry side of the scrum adjacent to the fabric. The resulting stack of materials is then pulled through a pultrusion die, where liquid resin, for example vinyl ester, is injected into the die. This resin not only "wets" out the top and bottom fabric layers, but migrates through the reinforcement fibers in the foam and the dry side of the scrum. The back half of the die is heated, which quickly cures the resin, to form solid composite skins with solid reinforcement fibers therein. The solid composite panels can them be cut to length using a flying saw.

Use of this method provides a polymerized skin that is more consistent than if the polymer, such as polyurethane had been sprayed, rolled or coated onto the skin after the composite panel had been formed. A more consistent wear resistance layer optimizes weight and thickness, preventing weak spots or the added weight of thicker spots.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A cargo pallet, comprising:

a. a composite panel comprising a sandwich structure having:

i. an upper fabric skin layer with a resinous binder;

ii. a foam core;

iii. a lower fabric skin layer with a resinous binder; and iv. a plurality of high modulus, solid reinforcing fibers extending completely through each of the skin layers and the core of the panel, the high modulus fibers having a fiber modulus of more than 5,000,000 psi; and b. a plurality of rails disposed around the circumference of the composite panel and connected thereto.

2. The pallet according to claim 1, wherein the upper and lower skin layers include fibers comprising at least one of: fiberglass, carbon, aramid, basalt, and Ultra-high Molecular Weight Polyethylene and hybrids thereof and the resin binder, the resin binder comprising at least one of epoxy, polyester, vinyl ester, polyurethane, polyimide, phenolic, polyamide, polyester, polycarbonate.

3. The pallet according to claim 1, wherein the bottom skin layer further comprises a wear resistant layer coated, sprayed or laminated thereto.

4. The pallet according to claim 1, wherein the foam core comprises at least one of polyurethane, vinyl, acrylic, and phenolic foam.

5. The pallet according to claim 1, wherein the foam core is a foam filled honeycomb.

6. The pallet according to claim 4, wherein the foam core comprises closed cells.

7. The pallet according to claim 4, wherein the foam core has a density of between 0.75 and 20 lbs/ft$^3$.

8. The pallet according to claim 1, wherein the reinforcing fibers comprise at least one of fiberglass, carbon, aramid, basalt, and Ultra-high Molecular Weight Polyethylene fibers.

9. The pallet according to claim 8, wherein the reinforcing fibers are arranged in the composite panel with a density of between about 0.25 and 16 fibers per square inch.

10. The pallet according to claim 9, wherein the reinforcing fibers form an angle of between about 30 degrees and about 90 degrees with respect to the surface of the lower skin layer.

11. The pallet according to claim 10, wherein the reinforcing fibers comprise first reinforcing fibers disposed perpendicular to the lower skin layer and second reinforcing fibers disposed oblique to the lower skin layer.

12. The pallet according to claim 1, wherein the upper and lower fabric skin layers of the panel have portions that extend outwardly beyond the foam core, and the rails each comprise a first arm and second arm snap fit between the portions of the upper and lower fabric layer that extend outwardly beyond the core.

13. The pallet according to claim 1, wherein each rail comprises a first arm and a second arm; and the composite panel further comprises an interface member, the interface member disposed adjacent to the periphery of the core and sandwiched between the upper skin layer and lower skin layer and including a pair of outwardly extending flanges; whereby the arms are snap fit between the flanges of the interface, such that the rails are easily removable from the composite panel.

14. The pallet according to claim 13, wherein at least one of the first and second arms further comprises at least one of protrusions and recesses; and the flanges of the interface member comprises at least one of protrusions and recesses;

wherein the snap fit comprises engagement of the respective projections and recesses.

15. The pallet according to claim 14 further comprising a rivet for assisting the connection between the respective rail and the interface layer.

16. The pallet according to claim 15, the rails further comprising an angled overhanging edge configured to compress the flanges of the interface member when the rail is fully engaged therewith.

17. The pallet according to claim 1, wherein the foam core comprises a fire resistant material that resists melting or burning up to 1500 degrees Fahrenheit.

18. An air cargo pallet, comprising:

a. a composite panel comprising a sandwich structure having:

i. an upper fabric skin layer with a resinous binder;

ii. a foam core;

iii. a lower fabric skin layer with a resinous binder;

iv. a plurality of high modulus, solid reinforcing fibers extending completely through each of the skin layers and the core of the panel, the high modulus fibers having a fiber modulus of more than 5,000,000 psi; and v. an interface member disposed around the periphery of the foam core and bonded between the upper skin layer and the lower skin layer; and b. a plurality of rails disposed around the circumference of the composite panel, a portion of each rail being snap fit within the interface member.

19. An air cargo pallet, comprising:

a. a composite panel comprising a sandwich structure having:

i. an upper skin layer having resin impregnated fibers;

ii. a foam core;

iii. a lower skin layer having resin impregnated fibers;

iv. a plurality of high modulus, solid reinforcing fibers extending through each of the lower skin layer, the foam core and the upper skin layer, the high modulus fibers having a fiber modulus of more than 5,000,000 psi; and v. an interface member disposed around the periphery of the foam core and disposed between the upper skin layer and the lower skin layer; and b. a plurality of metal rails snap fit within the interface member.

* * * * *